United States Patent [19]

Bonczyk

[11] 3,946,935

[45] Mar. 30, 1976

[54] BULK MATERIAL PACKAGING CONTAINER

[75] Inventor: Bruno C. Bonczyk, East Alton, Ill.

[73] Assignee: Alton Box Board Company, Alton, Ill.

[22] Filed: Sept. 21, 1973

[21] Appl. No.: 399,173

Related U.S. Application Data

[63] Continuation of Ser. No. 227,032, Feb. 17, 1972, abandoned.

[52] U.S. Cl. ..... 229/37 R; 229/49

[51] Int. Cl.[2] ..... B65D 5/02; B65D 5/44

[58] Field of Search ..... 229/15, 27, 28 R, 37 R, 229/41 B, 49, 29 B; 206/181

[56] References Cited

UNITED STATES PATENTS

| | | | |
|---|---|---|---|
| 2,893,623 | 7/1959 | Bates | 229/27 X |
| 3,047,204 | 7/1962 | Wolowicz | 229/49 X |
| 3,106,876 | 10/1963 | Dewhurst | 229/27 X |
| 3,130,892 | 4/1964 | Krueger et al. | 229/49 X |
| 3,135,453 | 6/1964 | Struble | 229/27 |
| 3,135,454 | 6/1964 | Struble et al. | 229/27 |
| 3,235,163 | 2/1966 | Hennessey | 229/37 R |
| 3,370,776 | 2/1968 | Kryzanowski | 229/27 |

*Primary Examiner*—William Price
*Assistant Examiner*—Stephen Marcus
*Attorney, Agent, or Firm*—Paul M. Denk

[57] ABSTRACT

In a packaging container of the type formed from paperboard and incorporating a support between a pair of opposing walls, said support being useful for preventing bulging of said container when laden with bulk material, and said support, in the container blank, is formed having its longitudinal dimension arranged parallel and in contiguity with the vertical heighth of said container walls, or its connecting flap.

In the method of forming such a container, after the blank has been cut to the desired shape, as aforesaid, the parallel support is folded over approximately a 90° angle for adherence to one wall panel, and then turned to allow for adherence of the other end of said support to the eventually opposing wall panel, and when the carton is compressed into its tubular form for deposition of the bulk materials, and simultaneously said support will bend once again in the proximity of its two ends approximately at 90° angles.

6 Claims, 7 Drawing Figures

BULK MATERIAL PACKAGING CONTAINER

CROSS REFERENCE TO RELATED APPLICATION.

This application is a continuation of the application of Bruno C. Bonczyk, Ser. No. 227,032, filed Feb. 17, 1972, and owned by a common assignee now abandoned.

BACKGROUND OF THE INVENTION

This invention relates generally to a reinforced packaging carton or container, and more particularly, pertains to a container which incorporates a strut that interconnects between two opposing walls to prevent the carton from bulging, with said strut having been formed in the blank in a design that provided for its parallel relationship with the major wall panels of the container.

Various forms of materials holding cartons that incorporate internal reinforcing structures to prevent contaianer bulging have been designed and constitute part of the prior art. Most of these cartons, and in particular their center supports, are quite complicated in structure, and normally consume a significant amount of paperboard in the cutting of the blank since their center supports project some distance from the main panel portions of the basic carton blank. Other forms of prior art cartons that incorporate some form or a strut or bridge adhered between opposing walls do not take into consideration the mechanics of simultaneously cutting the blank and folding it into a complete carton incorporating such a strut, but rather, either required manual effort or a separate mechanical operation to adhere the strut within the carton structure. One such carton is shown in the prior art patent to R. W. Griese, U.S. Pat. No. 3,197,113.

The basic object of the present invention is to provide an integral carton blank which incorporates a strut or support member which is designed in contiguity with the carton blank per se, and not projecting for any significant distances away from the carton blank as shown in the prior art.

It is a further object of this invention to provide a folding and reinforced carton structure which provides for a saving of considerable amount of paperboard in its manufacture due to the closeness of its support member to the carton blank in its formation stages.

It is another object of this invention to provide a reinforced packaging container in which a strut may be formed simultaneously with the formation of the carton all in the same sequence of mechanical operations.

A further object of this invention is to provide a method for incorporating a bridging member as in a bulk packaging container so as to prevent its bulging when filled with massy material.

These and other objects will become more apparent to those skilled in the art in light of the following summary, description of the preferred embodiment, and accompanying drawings.

SUMMARY OF THE INVENTION

In accordance with this invention, generally stated, a carton bank incorporating the usual front and back wall panels in addition to adjacent side wall panels, and end flaps, is initially formed as a paperboard blank. The usual connecting flap, such as for forming the carton into a tubular member through the application of glue to said flap is adhered to the edge of one of said wall panels. A support, which distinctly has its longitudinal portion in contiguity with either said glue flap or the edge of one of said wall panels, eventually through the folding of the container blank preferably upon automatic machinery, provides for the spanning of said support intermediate a pair of the opposing wall panels. Hence, in the formation of this container, a front wall panel and back wall panel will be formed having intermediate thereof the usual two sides of the carton, and then integrally along the edge of one of said wall panels the glue flap will be formed, and in adjacency thereto, there will likewise be formed the aforesaid support, which, as stated, is maintained in contiguity and in adjacency thereof, all in parallel with said wall and side panels, as distinct from the usual form of bridging member that projects perpendicularly for a length usually at least equivalent to the width of the folded carton.

In the folding of this reinforced packaging container upon the usual type of folding machinery, which has been adapted to provide the predetermined folds of this container into substantial closure, a portion of the support means is initially turned from its parallel relationship at approximately a 90° angle, with this turned end of said support then being adhered, as by a glue or other adhesive, approximately centrally of the interior surface of one of the wall panels. Then, either the support means and the wall in which it is adhered, or the opposing wall panel, may be folded approximately 180° to allow for adherence of the opposite end of said strut to the interior surface of said other and opposing wall panel. Then, with the turning of one of the side walls of the container into an overlying relationship with the aforesaid connecting or glue flap, and its adherence thereto, the container at that time may be formed into a tubular member, its end flaps closed, to provide the usual rectangular form of container that is readily available for holding bulk material, or the carton, in the blank stage, can be shipped to any processor who can then make use of the container for cartage of bulky material. In the folding or pressing of said carton blank into its tubular shape, additional approximately 90° turns will simultaneously be made once again to each end of said strut where it adheres to the panel walls of the container, so that in the tubular form, said strut will possess three folds each of approximately a 90° angle so as to allow for its spanning the distance between opposing walls of the shaped container. This additional turn required in this particular container may be one more than usually made in cartons of this type incorporating a reinforcing structure, but the advantages achieved through making this additional turn as evidenced in the saving of paperboard in the formation of this blank greatly outweighs the effort exerted in making this initial fold. Hence, the first turn of this supporting member is performed for the purpose of orienting the member from its parallel relationship in contiguity with the edge of the wall and side panels of the container to that direction which sets it in a position to provide for its projection at approximately a right angle from the longitudinal dimension of said wall panels.

DESCRIPTION OF THE PREFERRED EMBODIMENT

Figure 1:
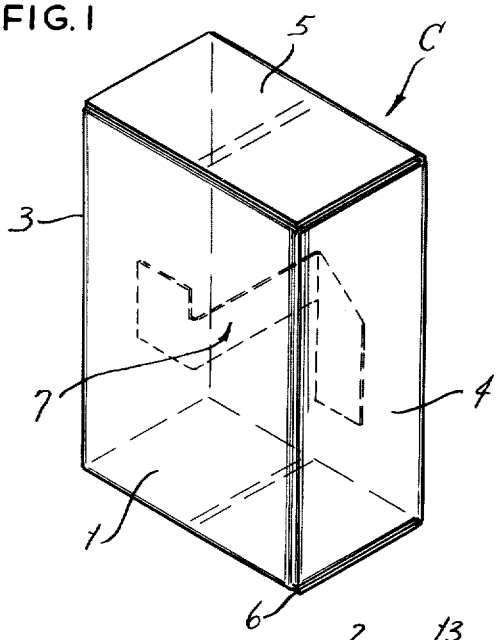
FIG. 1 provides an isometric view of the packaging container of this invention incorporating its support member therein.

In referring to the drawings, and in particularly FIG. 1, there is shown a reinforced carton C of the usual configuration incorporating a pair of opposing front wall 1 and a back wall 2, opposing side walls 3 and 4, with the usual end flaps, comprising the top panel 5 and bottom panel 6, which provide for complete closure of the container during usage. Shown within this sketch is a support means or strut 7 that bridges the distance intermediate a pair of opposing walls of the container, and which means is of sufficient strength to resist tension in the dimension of its length, and reinforce the major container walls against bulging as when it is laden with a bulk material, such as soap granules, fertilizer, or any other type of massy compositions.

Figure 6:
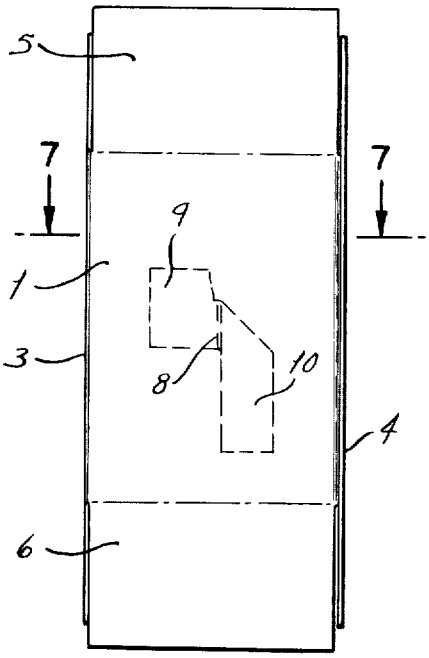
FIG. 6 provides a front view of the container blank after having been forced into its tubular form.
Figure 7:
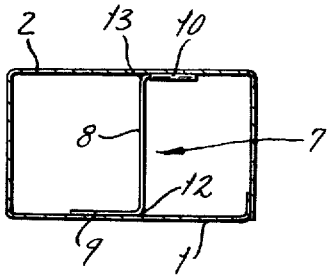
FIG. 7 provides a horizontal sectional view taken along the line 7—7 of FIG. 6, disclosing the packaging container, in tubular form, having its support spanning the distance intermediate two opposing wall panels.

By referring also to FIGS. 6 and 7, it can be seen that the carton blank, when folded into the tubular form, disposes its support means 7 between a pair of opposing walls, having an intermediate bridging portion 8 spanning the dimension between said walls, with each end portion 9 and 10 of said support being turned for connection, as by gluing, to the inner surfaces of said opposing walls. Essentially each of these ends of the support or strut is turned at that angle, herein shown as approximately at 90°, that provides for its contiguity with the surface of each wall, and its tight adherence thereto. It can be seen that since the major forces inducing bulging of any such container will be at a maximum at the approximate location where this strut connects to said container walls, sufficient area for gluing of these support ends, or tabs, must be provided and disposed at the proper angular relationship with respect to the inner surfaces of said walls.

As shown in FIG. 6, the support end 9 is arranged substantially laterally of the bridging portion 8 of the support while the other end 10 of said support is arranged in an opposite lateral direction and disposed substantially downwardly in its connection to the opposite panel of said container. The particular arrangement of these support ends in their connection to the container walls, and the reasons for their attachments in such manner, can be made more cognizably in a subsequent description of one method of folding the carton.

Figure 2:
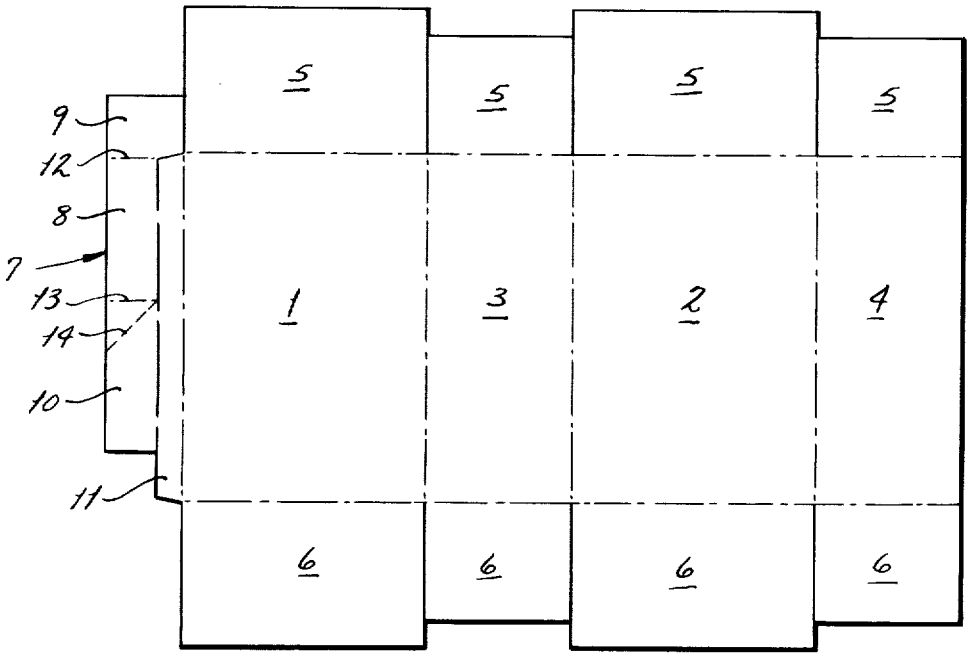
FIG. 2 provides a complete view of the entire blank of this packaging container showing the support as maintained in parallel relationship with the wall and side panels of this container.

In FIG. 2 is shown the container blank after it has been cut from, for example, paperboard stock, and it is significant to note that said blank is substantially of a rectangular shape, having little or no projections therefrom, even taken into regard the fact that the support means has also been integrally formed in this blank. This container blank comprises what will form into the major wall panels of the container, such a front wall 1, a back wall 2, and intermediate and adjacent side walls 3 and 4, with end flaps 5 and 6 being integrally connected along a series of fold lines so that they can be pivoted into closure when the container has been folded into its tubular form. Along one edge of the panel 1 is provided a connecting flap 11 which is designed and disposed for having glue applied to it, so that when the container is folded, said glue flap will be adhered to the exposed edge of the side panel 4. Also formed integrally substantially along the edge of the connecting flap 11 is the support means or strut 7, which as can be seen, in the blank form, is maintained substantially parallel with the vertical or heighth dimension of wall and side panels of the container, and in close proximity or contiguity with the connecting flap 11 and its adjacent front panel 1. Obviously, when the method of folding this container into closure is described, it will be seen that this support means 7 may be formed contiguously along the edge of the panel 1, or side panel 4, and likewise, the connecting flap 11 may either be formed in the blank adjacent to said support means 7, as shown, or it may even be formed at an opposite end of the carton blank. In other words, the blank may include the support member 7 being formed along the longitudinal edge of the panel 1, which the connecting flap 11 may be formed integrally along the edge of the side panel 4, at the other end of said blank.

For purposes of this description, it can be said that the longitudinal, height, or vertical direction of these wall panels and side panels are arranged upright upon the drawing, whereas the width dimensions of said panels are measured transversely of the blank as shown in FIG. 2.

The support means 7 is designed having an intermediate or bridging portion 8, which as previously described, spans the distance between opposing wall panels, as when the container is formed into an enclosure. One end or tab of said support means, as at 9, is demarcated from said intermediate portion 8 by means of a fold line 12. Likewise, the opposite end 10 of said support is set off from its portion 8 by means of a pair of fold lines 13 and 14.

Figure 3:
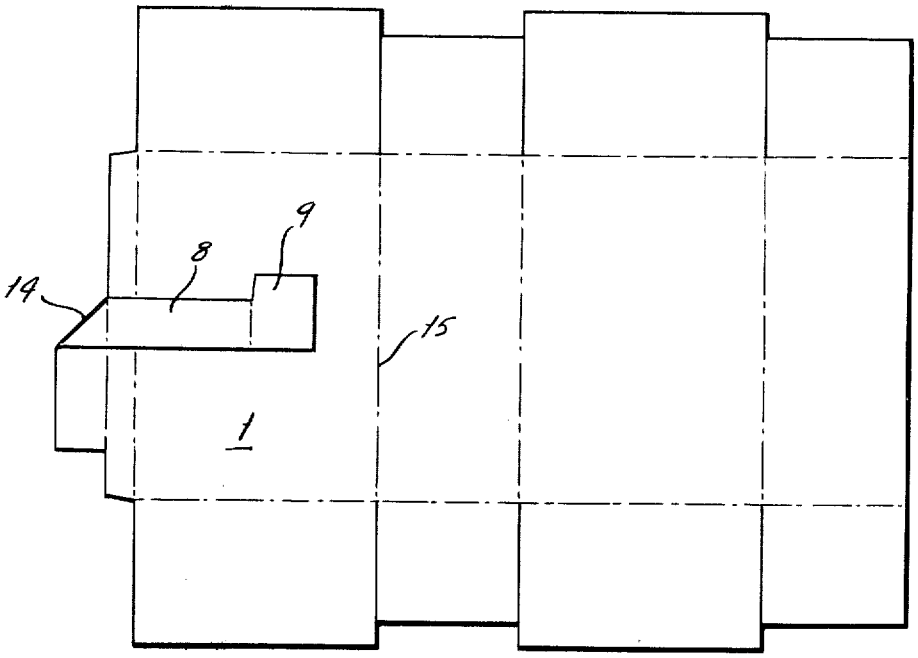
FIG. 3 provides a similar view of the container blank as shown in FIG. 2, with the initial turn being made to the support for its adherence to one of the wall panels.
Figure 4:
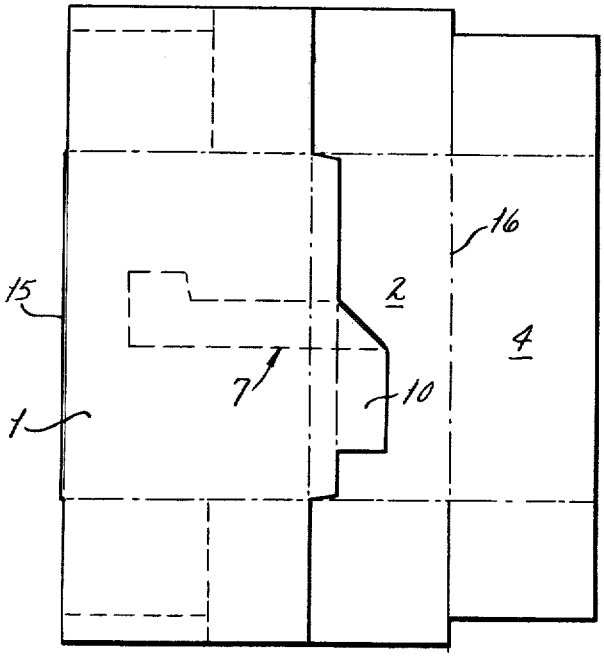
FIG. 4 is a view of the next step in folding of this container blank wherein the support and the now connecting wall panel are turned in preparation for adherence of the other end of said strut to the opposing wall panel.
Figure 5:
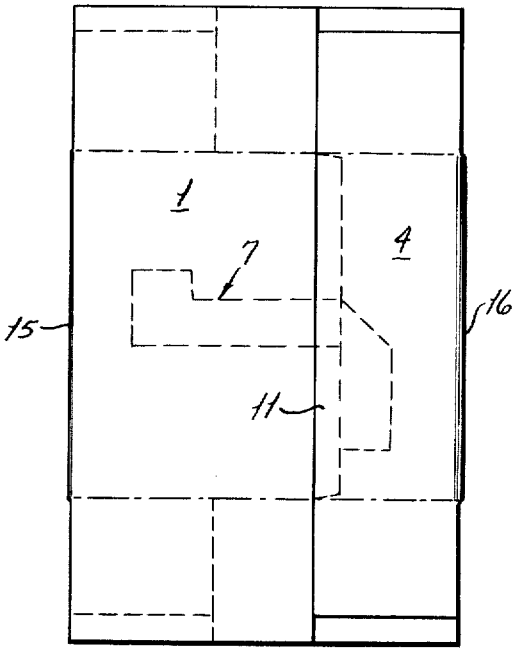
FIG. 5 provides a view of the next step in the folding of this container blank wherein the right side wall has been folded to provide for its adherence to the glue flap of said container blank.

The process for folding this packaging container, either manually, or through a machinery operation, is more aptly described, in a sequence of folds, as shown in FIGS. 3–5. Initially the intermediate portion 8 and its upper end 9 are folded simultaneously along the fold line 14 at approximately a 90° angle which orients this portion of the support at an angle perpendicularly with respect to the heighth of the underlying wall paanel 1, as distinct from its previously parallel relationship. In this initial folding operation, glue will have been applied to the support end 9 which provides for its quick adherence to the panel 1 upon contact. Following this step, the combined folded support means 7, the connecting flap 11, and the adhering panel 1 are folded over approximately 180° along the fold line 15, which, as can be seen, disposes the other end 10 of the support means approximately within the central vicinity of the now underlying and opposite wall panel 2, and simultaneously with this folding operation, glue will have been applied to the surface of the end 10 to provide for its prompt adherence to said panel 2. Finally, an additional fold is made preferable to the side panel 4 that provides for its overlying relationship with the connecting flap 11, which will have had an application of glue made to its exposed surface, so that the container will now have been formed into a folded carton blank, in which condition, it can now be shipped to the processor for utilizing as a packaging container in a business.

When the folded and flat container, as shown in FIG. 5, is to be used, a compressive force may be applied to the edges 15 and 16 of said blank, to provide for its urging into a tubular form, and its end flaps 5 and 6 may be folded over to provide for carton closure. During this final folding of the container into the tubular form, it can be seen that the two additional bends are simultaneously made in the member 7, and as seen in FIG. 7, one bend of approximately 90° is made along te fold line 12, while an additional fold of approximately 90° is made along the fold line 13 of said member. Obviously these two latter folds are defined assbeing made at approximately 90° angles, because this particular carton is disclosed as being rectangular in configuration. On the other hand, in the event that the container is made having, for example, a parallelogram shape in cross section, the folds of the support member might be made at angles other than 90°, and to those angles that may suitably dispose the support at its most suitable tension absorbing position.

Other variations in the construction and folding of the packaging container of this invention, within the scope of the appended claims may occur to those skilled in the art in light of the foregoing disclosure. For example, as previously described, the folds may be made in such a manner that the carton blank will have the support member 7 formed along one edge of the panels or walls, with the connecting flap 11 being formed in the blank along the edge at the other end of said blank. The described preferred blank is merely illustrative.

Having thus described the invention, what is claimed and desired to be secured by Letters Patent is:

1. In a blank for a packaging container of the type formed from paperboard and incorporating means for adhering to a pair of opposing wall panels to prevent container bulging when laden with bulk material, said blank having a pair of front and back wall panels, a pair of side wall panels for interconnecting between said front and said back wall panels when the blank is formed into a container, said means comprising a strut adhering to a pair of opposing wall panels when the blank is formed into a container, and upper and lower end flaps attached respectively to at least one upper and lower edge of the said panels, a connecting flap formed integrally adjacent an edge of one of said panels, said strut formed having its length dimension that is capable of spanning the distance between the front and back wall container panels being arranged in adjacency and substantially parallel with and removably attached to one of said panel and connecting flap along its vertical dimension, and said strut incorporating at least one fold line angularly disposed with respect to the vertical dimension of said panels to provide for an angular turn in said strut during container assembly, whereby said strut is sequentially removed from said parallel panel or connecting flap and folded to a perpendicular position for adherence to opposite panel walls as said panels and said flaps are folded into the container.

2. The invention of 1 wherein said strut at least along a portion of its length connects with one of said panel and connecting flap by a score-line.

3. The invention of claim 1 wherein said angularly disposed fold line is arranged at approximately a 45° angle with the edge of the adjacent and attached panel or flap.

4. The invention of claim 1 and wherein the strut is capable of turning to partially overlap itself at one location along its length during folding of the container blank.

5. In a packaging container of the type formed from a paperboard blank including opposing front and back wall panels, a pair of opposing side wall panels, end flaps, and a support interconnecting between a pair of said opposing wall panels to prevent container bulging when laden with bulk material, the improvement which comprises, said support proximate one of its ends being bent approximately 90° and attached to the inner surface of the opposite wall panel, and said other end of the support having an overlapping portion.

6. The invention of claim 5 wherein the first end of the support connecting to a wall panel is turned laterally of said support, and the other end of said support is folded over and connected to the opposite wall panel in a different direction from the first end.

* * * * *